United States Patent [19]

Peters

[11] Patent Number: 4,533,142

[45] Date of Patent: Aug. 6, 1985

[54] MECHANICALLY ACTUATED OBJECT-PROPELLING APPARATUS

[75] Inventor: Albin Peters, Chicago, Ill.

[73] Assignee: Wico Corporation, Niles, Ill.

[21] Appl. No.: 529,349

[22] Filed: Sep. 6, 1983

[51] Int. Cl.[3] ..... A63B 71/00

[52] U.S. Cl. ..... 273/129 W; 124/36; 124/79

[58] Field of Search ..... 273/129 R, 129 S, 129 T, 273/129 V, 129 W, 1 M, 85 A; 124/36, 41 B, 41 C, 79

[56] References Cited

U.S. PATENT DOCUMENTS

| | | | |
|---|---|---|---|
| 2,582,290 | 1/1952 | Smith . | |
| 3,142,294 | 7/1964 | Baldwin | 124/41 B |
| 3,300,215 | 1/1967 | Coffey | 273/129 W |
| 4,203,603 | 5/1980 | Konta | 273/129 W |
| 4,212,466 | 7/1980 | Wildman et al. | 273/129 W |

*Primary Examiner*—Richard C. Pinkham
*Assistant Examiner*—T. Brown
*Attorney, Agent, or Firm*—Emrich & Dithmar

[57] ABSTRACT

A mechanically-operated object-engaging member for a game is pivotally mounted on a shaft to which is fixedly secured a drive cam disposed in camming engagement with one end of a third-class lever. A spring on the cam biases it and the lever to a normal rest condition, the lever having a magnetic portion which is attracted to a permanent magnet for magnetically holding the lever in the rest condition. A manually-operated actuator linkage applies a force to the lever to break the magnetic attraction and drive the lever away from the magnet to operate the cam and object-engaging member. A separate bias element may urge the actuator linkage to a normal rest condition. The object-engaging member can be mounted on a playfield board and confined to a predetermined oscillating movement relative to the playfield board.

20 Claims, 4 Drawing Figures

20
21
22
23
24
25
26
27
28
30
31
33
34
35
36
37
41
42
43
45
50
51
55
56
58
60
61
62
63
64
65
66
68
70
71
73
2.

MECHANICALLY ACTUATED OBJECT-PROPELLING APPARATUS

BACKGROUND OF THE INVENTION

The present invention relates to object-propelling apparatus for games, and in particular to selectively manually operable object-propelling apparatus such as the type including a pivoting object-engaging member.

Typically, such object-propelling apparatus for games is electromechanically operated. More specifically, a push button or the like is manually operated for closing a switch to energize a solenoid, which in turn drives the object-propelling apparatus. In such electromechanical devices, the propelling force applied to the object by the object-engaging member is completely independent of the manual force exerted by the player. This results in a lack of "feel" or "touch" experienced by the player.

Furthermore, these prior object-propelling devices require the use of expensive solenoids and electrical wiring which must be manually connected thereby adding to the cost of the device. In addition, solenoids are subject to burnout, necessitating costly maintenance or replacement.

SUMMARY OF THE INVENTION

It is a general object of the present invention to provide an improved object-propelling apparatus for a game which avoids the disadvantages of prior propulsion devices while affording additional structural and operating advantages.

An important object of this invention is the provision of object-propelling apparatus which is completely mechanical, requiring no electrical circuitry.

It is another object of this invention to provide object-propelling apparatus of the type set forth, wherein the propelling force applied to the object is dependent upon the manual force applied to the actuating mechanism by the player.

In connection with the foregoing object, it is another object of this invention to provide object-propelling apparatus of the type set forth which provides a snap-action engagement of the propulsion device with the object.

It is another object of the invention to provide object-propelling apparatus of the type set forth which is of simple and economical construction.

These and other objects of the invention are attained by providing propulsion apparatus for propelling an object along the playfield board of a game, the propulsion apparatus comprising: a permanent magnet mounted on the playfield board, object-propelling means movably mounted on the playfield board for propelling engagement with an associated object, the object-propelling means including a magnetic portion magnetically coupled to the permanent magnet and normally held in contact therewith by a predetermined magnetic coupling force, and manually operable actuating means coupled to the object-propelling means for applying thereto a force sufficient to overcome the predetermined magnetic coupling force to move the object-propelling means out of engagement with the permanent magnet and into propelling engagement with the associated object.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages should be readily understood and appreciated.

DESCRIPTION OF THE PREFERRED EMBODIMENT

Figures 1, 2:
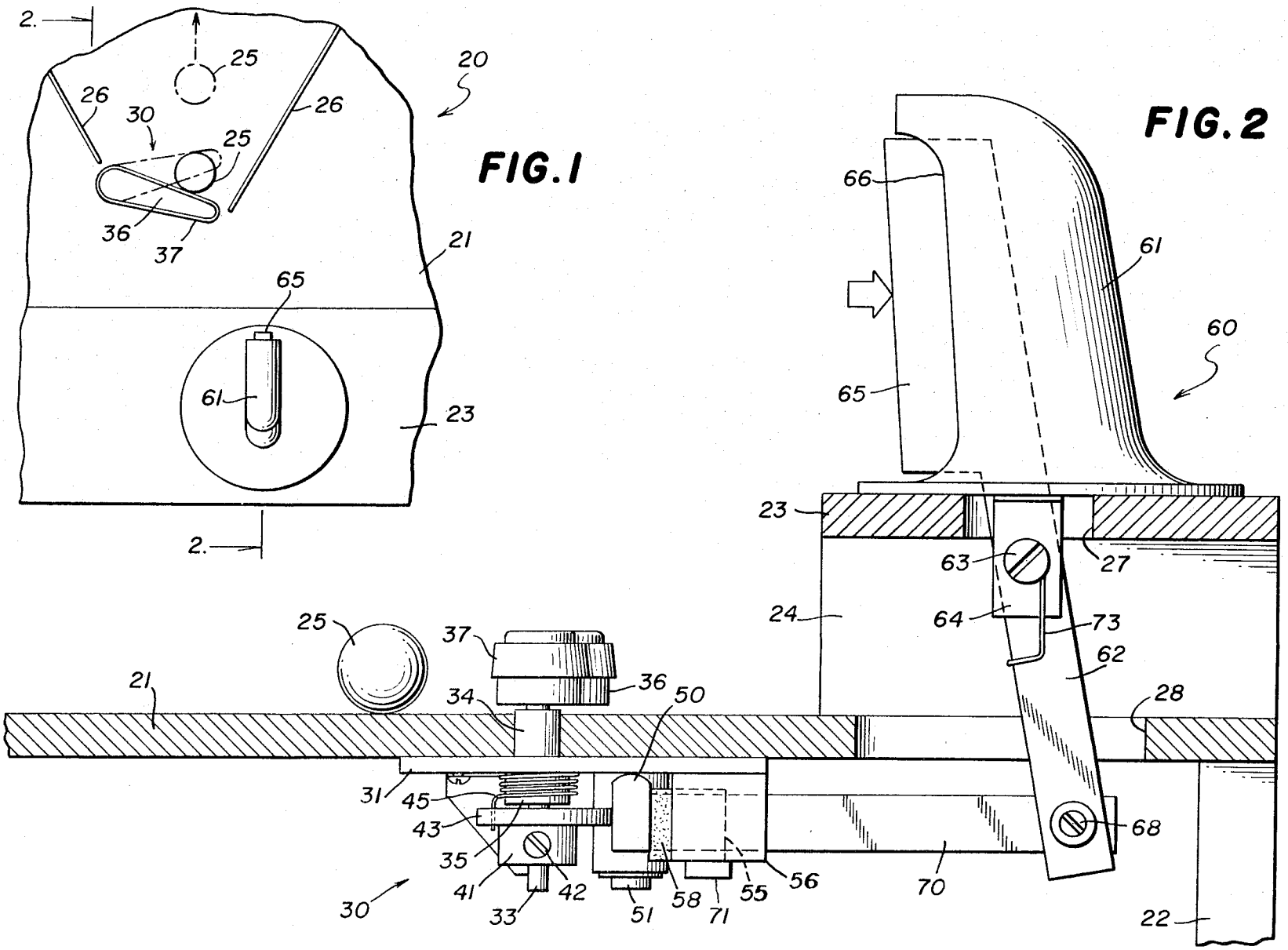
FIG. 1 is a fragmentary top plan view of a game incorporating the mechanically actuated object-propelling apparatus of the present invention.
FIG. 2 is an enlarged, fragmentary view in vertical section taken along the line 2—2 in FIG. 1 and illustrating the apparatus in its normal rest position.

Referring to FIGS. 1 and 2 of the drawings, there is illustrated a game, generally designated by the numeral 20, incorporating a propulsion apparatus 30 constructed in accordance with and embodying the features of the present invention. The game 20 includes a playfield board 21 supported on a cabinet, one wall 22 of which is shown. The playfield board 21 is provided at the lower or front end thereof with a raised end wall 23 disposed substantially parallel to the playfield board 21 and elevated a predetermined distance thereabove on side supports 24. One or more objects 25 are adapted for movement along the upper surface of the playfield board 21. Guides 26 may be provided on the playfield board 21 for directing an object 25 to the propulsion apparatus 30. A small elongated aperture 27 is formed in the raised end wall 23 and is disposed for vertical registry with a larger elongated aperture 28 which is formed in the playfield board 21, for a purpose to be explained more fully below.

Figure 3:
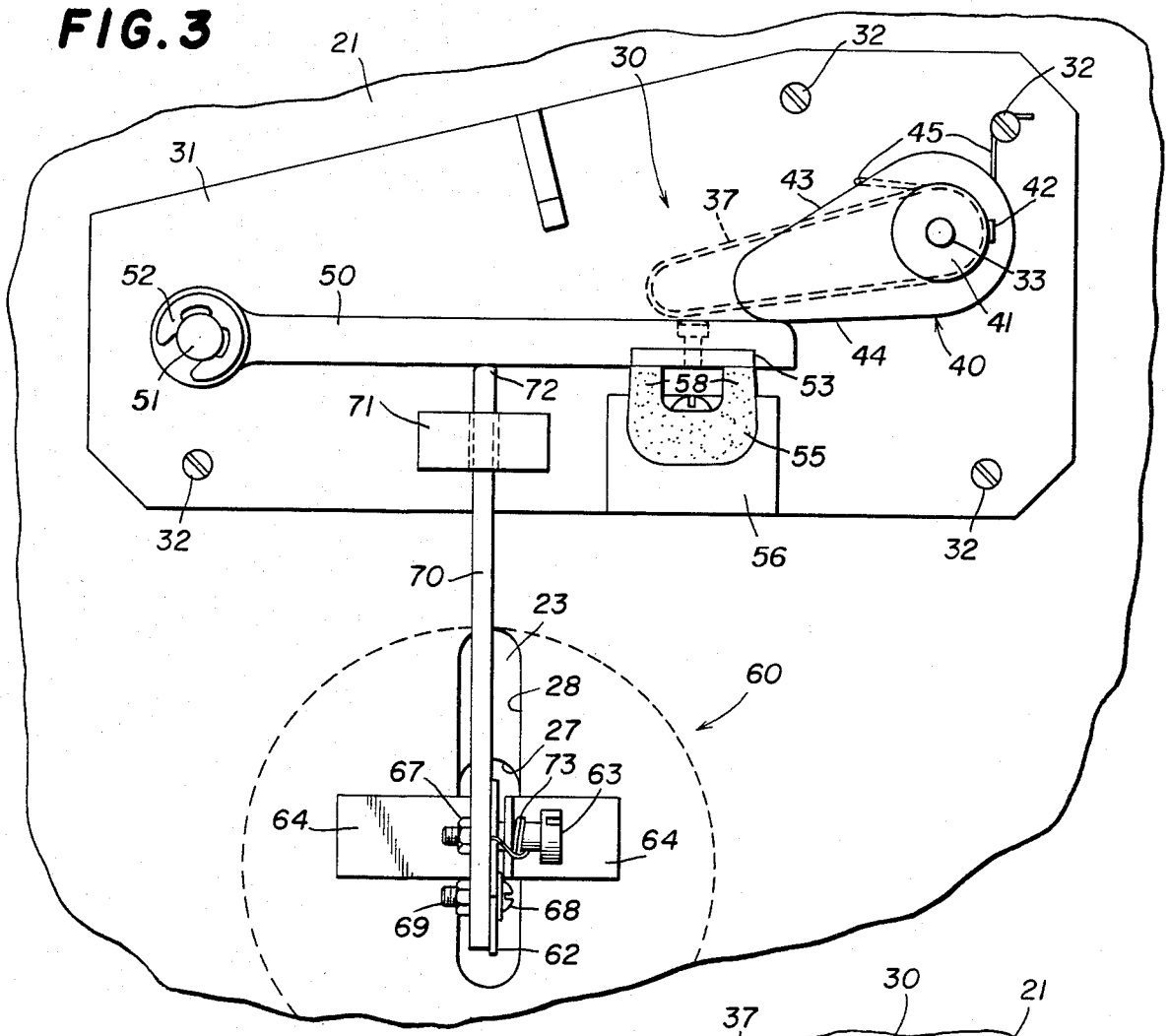
FIG. 3 is a bottom plan view of the apparatus of FIG. 2.
Figure 4:
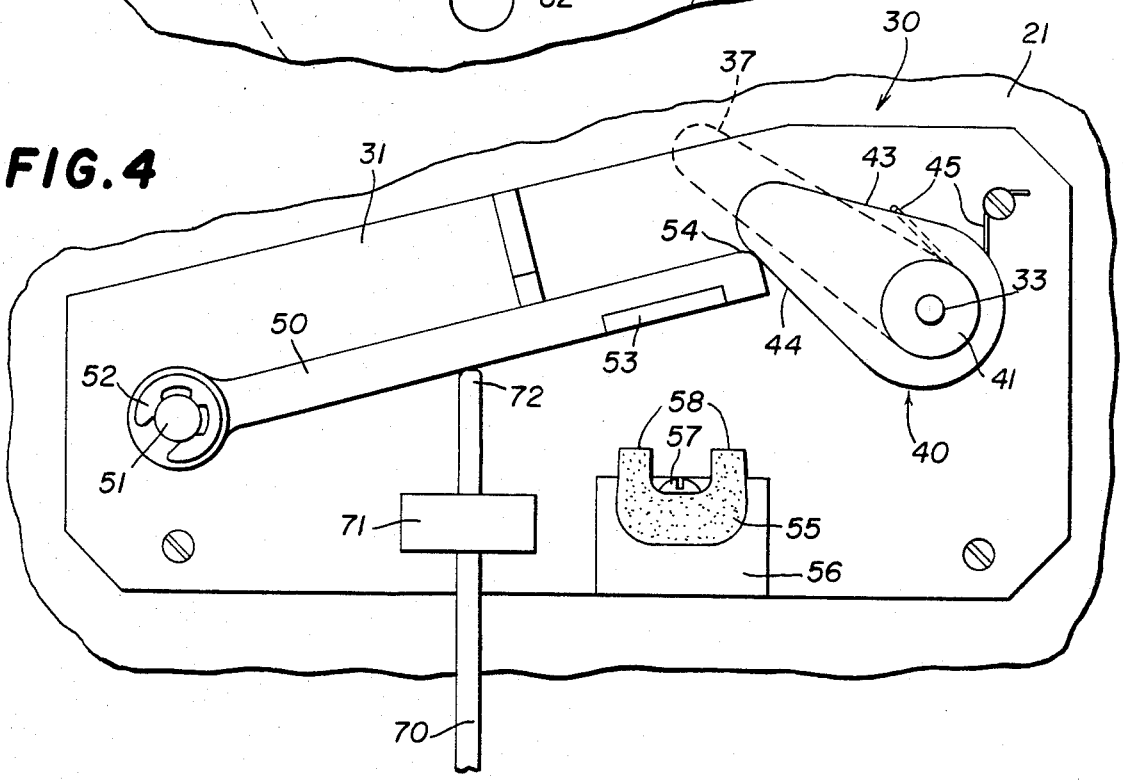
FIG. 4 is a fragmentary view similar to FIG. 3, illustrating the apparatus in its object-propelling position.

Referring now also to FIGS. 3 and 4 of the drawings, the propulsion apparatus 30 includes a flat mounting plate 31 which is fixedly secured to the underside of the playfield board 21 by suitable fasteners 32, such as screws or the like. A shaft 33 is carried by the mounting plate 31 and has the axis thereof disposed substantially perpendicular to the playfield board 21. More specifically, the shaft 33 extends through a bushing 34 received in a complementary opening in the playfield board 21, the shaft 33 being rotatably mounted in a bearing 35 on the mounting plate 31. The upper end of the shaft 33 projects above the playfield board 21 and is fixedly secured to one end of an elongated object-engaging member 36 provided with an encircling rubber band 37 disposed for engagement with an object 25 moving along the playfield board 21. Fixedly secured to the other end of the shaft 33 beneath the playfield board 21 is a drive cam, generally designated by the numeral 40, the cam 40 having a cylindrical hub 41 encircling the shaft 33 and fixedly secured thereto, as by a set screw 42. The cam 40 has an elongated cam lobe 43 provided with a camming surface 44. A torsion spring 45 encircles the bearing 35 and has one end thereof anchored to one of the fasteners 32 and the other end thereof disposed in engagement with the drive cam 40 for resiliently urging it toward rotation in a counterclockwise direction, as viewed in FIGS. 3 and 4.

The propulsion apparatus 30 also includes an elongated drive lever 50 having one end thereof mounted for pivotal movement about the axis of a pivot pin 51 which depends from the mounting plate 31 substantially parallel to the shaft 33. The drive lever 50 may be retained in place on the pivot pin 51 by a E-ring 52. The drive lever 50 is generally rectangular in transverse cross section and is provided adjacent to the distal end thereof with a magnetic metallic insert 53. The distal end of the drive lever 50 defines a bearing tip 54 which is disposed for camming engagement with the camming surface 44 of the drive cam 40, as is best illustrated in FIGS. 3 and 4. A generally C-shaped permanent magnet 55 is fixedly secured in a support bracket 56 on the mounting plate 31, as by a fastener 57. The permanent magnet 55 has legs 58 which project a predetermined distance beyond the support bracket 56 for engagement with the magnetic insert 53 on the drive lever 50.

The propulsion apparatus 30 also includes an actuating assembly, generally designated by the numeral 60, with includes a hollow handle sheath 61 mounted on the raised end wall 23 of the game 20 above the aperture 27 therein. An elongated lever 62 extends through the apertures 27 and 28 and is mounted intermediate its ends for pivotal movement about the axis of a pivot pin 63 supported between a pair of brackets 64 carried by the handle sheath 61. The lever 62 has an enlarged trigger portion 65 disposed within the handle sheath 61 and projecting forwardly therefrom beyond a curved recess 66 in the front end of the handle sheath 61 for access by a player. The pivot pin 63 has one end thereof threaded for cooperation with a nut 67 (see FIG. 3) to hold the pivot pin 63 in place. The lower end of the lever 62 is pivotally coupled by a coupling screw 68 and a cooperating nut 69 to one end of an elongated crank arm 70 which extends beneath the playfield board 21 generally parallel thereto. The forward end of the crank arm 70 extends through a guide bracket 71 depending from the mounting plate 31, the distal or actuating end 72 of the crank arm 70 being disposed for engagement with the drive lever 50 intermediate the ends thereof (see FIGS. 3 and 4). A torsion spring 73 has one end thereof anchored to the pivot pin 63 and the other end in engagement with the lever 62, resiliently to urge the lever 62 toward rotation in a counterclockwise direction, as viewed in FIG. 2.

In operation, the propulsion apparatus 30 is normally held in a rest condition, illustrated in FIGS. 2. and 3 and in solid line in FIG. 1. In this rest condition, the magnetic insert 53 of the drive lever 50 is disposed in contact with the legs 58 of the permanent magnet 55, being held in this position by magnetic attraction with a predetermined magnetic force. The drive cam 40 is held in engagement with the bearing tip 54 of the drive lever 50 by the torsion spring 45, this biasing action also serving to urge the drive lever 50 into engagement with the permanent magnet 55. The drive lever 50 also serves to hold the actuating assembly 60 in its position illustrated in FIG. 2, with the trigger portion 65 of the lever 62 projecting from the handle sheath 61 for access by a player. The torsion spring 73 also serves to bias the actuating assembly 60 to this rest condition.

When it is desired to actuate the propulsion apparatus 30 for propelling an object 25 with the object-engaging member 36, the player manually grips the handle sheath 61, pulling the trigger portion 65 of the lever 62 with his fingers in the direction of the arrow in FIG. 2. This action pivots the lever 62 in a clockwise direction, as viewed in FIG. 2, thereby driving the crank arm 70 forwardly, or to the left as viewed in FIG. 2. The actuating end 72 of the crank arm 70 engages the drive lever 50 for driving it into pivotal rotation in a counterclockwise direction, as viewed in FIGS. 3 and 4, thereby operating the drive lever 50 as a third class lever. This pivotal movement of the drive lever 50 in turn pivots the drive cam 40 in a clockwise direction, as viewed in FIG. 4, for pivoting the object-engaging member 36 to the broken-line position illustrated in FIG. 1, into propelling engagement with the object 25.

It is a significant aspect of the present invention that the propulsion apparatus 30 does not move from its rest condition until the force exerted by the player on the trigger portion 65 of the lever 62 is sufficient to overcome the magnetic force holding the drive lever 50 against the permanent magnet 55. This manually-applied force may be less than the magnetic force of attraction exerted by the permanent magnet 55 because of the force-multiplying effect of the levers 62 and 50. Once the drive lever 50 separates from the permanent magnet 55, the magnetic force of attraction rapidly diminishes so that the drive lever 50 rapidly accelerates away from the permanent magnet 55. Thus, there is an initial buildup of potential energy in the actuating assembly 60, which potential energy is then suddenly converted to the kinetic energy of the drive lever 50 resulting in a "snap action" driving of the object-engaging member 36. In general, the force applied to the object 25 by the object-engaging member 36 will be proportional to the manual force applied by the player to the trigger portion 65, as long as this manual force is in excess of that force necessary to break the magnetic attraction of the permanent magnetic 55 on the drive lever 50. The drive cam 40 and the ob- ject-engaging member 36 also comprise levers which further serve to multiply the force applied by the player to the trigger portion 65. Thus, for example, 5 pounds of force applied to the trigger portion 65 may result in 15 pounds of force being applied to the object 25 by the object-engaging member 36.

When the trigger portion 65 of the lever 62 is released, the propulsion apparatus 30 is returned to its rest condition under the urging of the torsion springs 45 and 73.

In a constructional form of the present invention, the mounting plate 31, the object-engaging member 36, the drive cam 40, the drive lever 50, the support bracket 56, the handle sheath 61, the lever 62, the brackets 64, the crank arm 70 and the guide bracket 71 may all be formed of a suitable plastic material. The magnetic insert 53 may be formed of a suitable magnetically-permeable metal. By way of example, the object 25 could be a ball, the game 20 could be a pinball game and the object-engaging member 36 could be a flipper.

From the foregoing, it can be seen that there has been provided an improved object propulsion apparatus which is of simple and economical construction, is entirely mechanical in operation, requiring no electrical circuitry or components, and which provides a degree of control over the force with which the object is impacted by the propulsion apparatus 30, enhancing the "feel" of the apparatus experienced by a player.

I claim:

1. Propulsion apparatus for propelling an object along the playfield board of a game, said propulsion apparatus comprising: a permanent magnet mounted on the playfield board, object-propelling means, means movably mounting said object-propelling means on the playfield board and confining said object-propelling means to a predetermined oscillating movement thereto for propelling engagement with an associated object, said object-propelling means including a magnetic portion magnetically coupled to said permanent magnet and normally held in contact therewith by a predetermined magnetic coupling force, and manually operable actuating means coupled to said object-propelling means for applying thereto a force sufficient to overcome the predetermined magnetic coupling force to move said object-propelling means out of engagement with said permanent magnet and into propelling engagement with the associated object.

2. The propulsion apparatus of claim 1, wherein said object-propelling means is mounted for pivotal movement about a predetermined axis.

3. The propulsion apparatus of claim 2, wherein said predetermined axis is disposed substantially perpendicular to the playfield board.

4. The propulsion apparatus of claim 1, wherein said object-propelling means includes a single object-engaging member.

5. The propulsion apparatus of claim 1, wherein said actuating means is indirectly coupled to said object-propelling means.

6. The propulsion apparatus of claim 1, and further including bias means resiliently urging said object-propelling means to a normal rest condition wherein said magnetic portion is in contact with said permanent magnet.

7. The propulsion apparatus of claim 1, and further including bias means resiliently urging said actuating means to a normal rest condition wherein said magnetic portion is disposed in contact with said predetermined magnet.

8. The propulsion apparatus of claim 1, wherein said actuating means includes an actuating lever disposed for manipulation by a user and linkage means coupling said lever to said object-propelling means.

9. The propulsion apparatus of claim 1, wherein the object is a ball.

10. Propulsion apparatus for propelling an object along the playfield board of a game, said propulsion apparatus comprising: a permanent magnet mounted on the playfield board, object-propelling means movably mounted on the playfield board for propelling engagement with an associated object, drive means movably mounted on the playfield board for engagement with said object-propelling means to effect object-propelling movement thereof, said drive means including a magnetic portion magnetically coupled to said permanent magnet and normally held in contact therewith by a predetermined magnetic coupling force, and manually operable actuating means coupled to said drive means for applying thereto a force sufficient to overcome the predetermined magnetic coupling force for moving said drive means out of engagement with said permanent magnet thereby to drive said object-propelling means into propelling engagement with the associated object.

11. The propulsion apparatus of claim 10, wherein said object-propelling means and said drive means are respectively mounted for pivotal movement about predetermined axes.

12. The propulsion apparatus of claim 11, wherein each of said predetermined axes is disposed substantially perpendicular to the playfield board.

13. The propulsion apparatus of claim 10, wherein said object-propelling means includes a single object-engaging member.

14. The propulsion apparatus of claim 10, wherein said drive means includes a non-metallic lever, said magnetic portion comprising a metallic insert in said lever.

15. The propulsion apparatus of claim 10, and further including bias means resiliently urging said object-propelling means to a normal rest condition holding said magnetic portion of said drive means in contact with said permanent magnet.

16. The propulsion apparatus of claim 10, and further including stop means disposed for engagement with said drive means to limit the movement thereof away from said permanent magnet.

17. The propulsion apparatus of claim 10, wherein said drive means comprises a third class lever.

18. Propulsion apparatus for propelling an object along the playfield board of a game, said propulsion apparatus comprising: a permanent magnet mounted on the playfield board, object-propelling means movably mounted on the playfield board, said object-propelling means having an object-engaging portion for propelling engagement with an associated object and a drive portion, drive means movably mounted on the playfield board for driving engagement with said drive portion for moving said object-engaging portion into propelling engagement with the object, said drive means including a magnetic portion magnetically coupled to said permanent magnet and normally held in contact therewith by a predetermined magnetic coupling force, and manually operable actuating means coupled to said drive means for applying thereto a force sufficient to overcome the predetermined magnetic coupling force for moving said drive means out of engagement with said permanent magnet thereby to move said drive portion for driving said object-engaging portion into propelling engagement with the associated object.

19. The propulsion apparatus of claim 18, and further including bias means resiliently urging said drive portion to a normal rest condition holding said magnetic portion of said drive means in contact with said predetermined magnet.

20. The propulsion apparatus of claim 18, wherein said object-engaging portion and said drive portion are both fixedly secured to a common shaft for pivotal movement about the axis of said shaft.

* * * * *

UNITED STATES PATENT AND TRADEMARK OFFICE

CERTIFICATE OF CORRECTION

PATENT NO. : 4,533,142

DATED : August 6, 1985

INVENTOR(S) : Albin Peters

It is certified that error appears in the above-identified patent and that said Letters Patent are hereby corrected as shown below:

Claim 1, line 10, after "movement", insert --relative--.

Signed and Sealed this

Fourth Day of November, 1986

[SEAL]

*Attest:*

DONALD J. QUIGG

*Attesting Officer*

*Commissioner of Patents and Trademarks*